US007331290B1

(12) United States Patent
Keil

(10) Patent No.: US 7,331,290 B1
(45) Date of Patent: Feb. 19, 2008

(54) FUZE EXPLOSIVE ORDNANCE DISPOSAL (EOD) CIRCUIT

(75) Inventor: Robert E. Keil, Glenwood City, WI (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 11/284,511

(22) Filed: Nov. 22, 2005

Related U.S. Application Data

(63) Continuation of application No. 10/441,665, filed on May 20, 2003, now Pat. No. 6,966,261.

(51) Int. Cl.
*F42B 3/182* (2006.01)

(52) U.S. Cl. ..... 102/202.3

(58) Field of Classification Search ..... 102/202.3, 102/202.4

See application file for complete search history.

(56) References Cited

U.S. PATENT DOCUMENTS

| | | | | |
|---|---|---|---|---|
| 3,638,035 | A * | 1/1972 | Murphy et al. | 307/141 |
| 3,862,602 | A | 1/1975 | Manning | 102/220 |
| 4,047,482 | A | 9/1977 | Kervizic et al. | 102/427 |
| 4,137,850 | A | 2/1979 | Donner | 102/215 |
| 4,536,693 | A | 8/1985 | Marek | 320/166 |
| 4,726,291 | A | 2/1988 | Lefranc | 102/214 |
| 4,779,511 | A | 10/1988 | Proctor et al. | 86/50 |
| 5,387,257 | A | 2/1995 | Tari et al. | 192/226 |
| 5,689,084 | A | 11/1997 | Malotky et al. | 102/293 |
| 5,886,287 | A | 3/1999 | Will et al. | 102/220 |
| 5,932,834 | A | 8/1999 | Lyon et al. | 102/226 |
| 6,035,783 | A | 3/2000 | Cho | 102/235 |
| 6,634,298 | B1 | 10/2003 | Denney | 102/206 |

OTHER PUBLICATIONS

Webster's Ninth New Collegiate Dictionary; 3 pages; 1985.*
Webster's Encyclopedic Unabridged Dictionary; 3 pages including p. 779.*
Definition of the term "fuse" as provided by WordNet on Mar. 31, 2007 (2 pages).*

* cited by examiner

*Primary Examiner*—Stephen M Johnson
(74) *Attorney, Agent, or Firm*—Vidas, Arrett & Steinkraus, P.A.

(57) ABSTRACT

The present invention comprises an electronic Explosive Ordnance Disposal (EOD) circuit which is desirably used with fuzed explosive weapons, such as projectiles having a nominal mission time. After expiration of the mission time, if the explosive has not detonated, the inventive circuit controls the energy supplied to the fuze detonation circuit to a level that is less than a threshold level required by the fuze for detonation, thereby preventing subsequent detonation of the explosive.

19 Claims, 2 Drawing Sheets

FUZE EXPLOSIVE ORDNANCE DISPOSAL (EOD) CIRCUIT

CROSS-REFERENCE TO RELATED APPLICATIONS

This application is a Continuation application from Ser. No. 10/441,665 filed May 20, 2003, now U.S. Pat. No. 6,966,261, which issued or Nov. 22, 2005, the entire contents of which is hereby incorporated by reference.

STATEMENT REGARDING FEDERALLY SPONSORED RESEARCH

The U.S. Government has a paid-up license in this invention and the right in limited circumstances to require the patent owner to license others on reasonable terms as provided for by the terms of contract number DAAA21-92-C-0075 awarded by the Army.

BACKGROUND OF THE INVENTION

This invention relates generally to fuze devices which render a fuze safe to handle, and more particularly to a circuit for preventing detonation of an explosive after a predetermined period of time has lapsed, such as a thirty minute time period. In a preferred embodiment, the circuit comprises a fuze Explosive Ordnance Disposal (EOD) circuit.

The use of explosive weapons and fuzes are known in the art. On occasion, explosive devices fail to detonate at the appropriate time. Such munitions are referred to as duds, and are often very dangerous because the device may remain armed and therefore capable of high order detonation for an indefinite period of time. Duds typically present a danger to friendly personnel subsequently operating in the field, battlefield cleanup crews and even civilians long after a time of conflict.

When an explosive device has failed to detonate within a predetermined mission time, or the period of time within which proper detonation can be expected, it is desirable to render the fuze safe to prevent subsequent detonation.

Prior art methods of accomplishing sterilization of a fuze have typically used mechanical means of interrupting the battery power. For example, the M762/M767 fuzes utilize a mechanical spin switch that closes the battery circuit only while the fuze is experiencing a spin force.

Mechanical devices can have limited reliability and higher failure rates when compared to electronic devices that perform similar functions. Interacting mechanical components can wear, corrode and even seize over time. Devices with moving parts may also have difficulty withstanding the high shock levels associated with the normal operating environment of explosives devices, particularly with respect to artillery and other projectile weapons.

Some fuzes with electrically initiated explosive trains, such as the XM773 fuze, simply use a resistor to dissipate the firing energy and any remaining battery energy to below a safe voltage or energy level.

However, for many present fuzes, which are designed to be used in a variety of applications, a simple resistor dissipation circuit is not practical. Multi-option fuzes, such as the M782 MOFA fuze, have multiple operating modes and are designed to satisfy a wide range of current requirements. As such, a resistor dissipation circuit is not always sufficient to reliably dissipate the energy from both the firing capacitor and the battery within the desired time frame, which is often thirty minutes.

Therefore, it would be desirable to provide a device for electronically preventing detonation of an explosive that failed to properly detonate within a predetermined mission time. Desirably, the device will reliably function with all operating modes and for all applications of a multi-option fuze. Further, it would be desirable to produce such a device using common components that are available at a relatively low cost.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

All US patents and applications and all other published documents mentioned anywhere in this application are incorporated herein by reference in their entirety.

BRIEF SUMMARY OF THE INVENTION

The presently claimed invention prevents detonation of an explosive after a given time lapse by reducing the energy supplied to the fuze to a value below a no-fire threshold that is required for fuze detonation. In some cases, the power source is completely isolated from the firing circuit.

In one embodiment, the invention is directed to an explosive ordnance disposal circuit used in conjunction with a fuze of an explosive. The circuit includes an electronic timer, a trigger and an output circuit providing an output voltage to the fuze. After the electronic timer has lapsed, the trigger is initiated and output voltage provided to the output circuit is controlled to a level lower than the threshold required for fuze operation.

In another embodiment, the invention is directed to an apparatus for dissipating the firing energy of a fuze. The apparatus includes a power source, an electronic timer, a fuze output having an output voltage, a trigger and a no-fire threshold circuit. After the electronic timer has lapsed, the trigger is initiated and the no-fire threshold circuit is activated to reduce the output voltage of the fuze output below a threshold voltage required for the fuze to fire.

Other embodiments may further include a second trigger that may be initiated after the first trigger. The second trigger desirably causes the power source to become isolated from the fuze or the output to the fuze.

These and other embodiments which characterize the invention are pointed out with particularity in the claims annexed hereto and forming a part hereof. However, for a better understanding of the invention, its advantages and objectives obtained by its use, reference should be made to the drawings which form a further part hereof and the accompanying descriptive matter, in which there is illustrated and described embodiments of the invention.

BRIEF DESCRIPTION OF THE SEVERAL VIEWS OF THE DRAWING(S)

A detailed description of the invention is hereafter described with specific reference being made to the drawings.

DETAILED DESCRIPTION OF THE INVENTION

Figure 1:
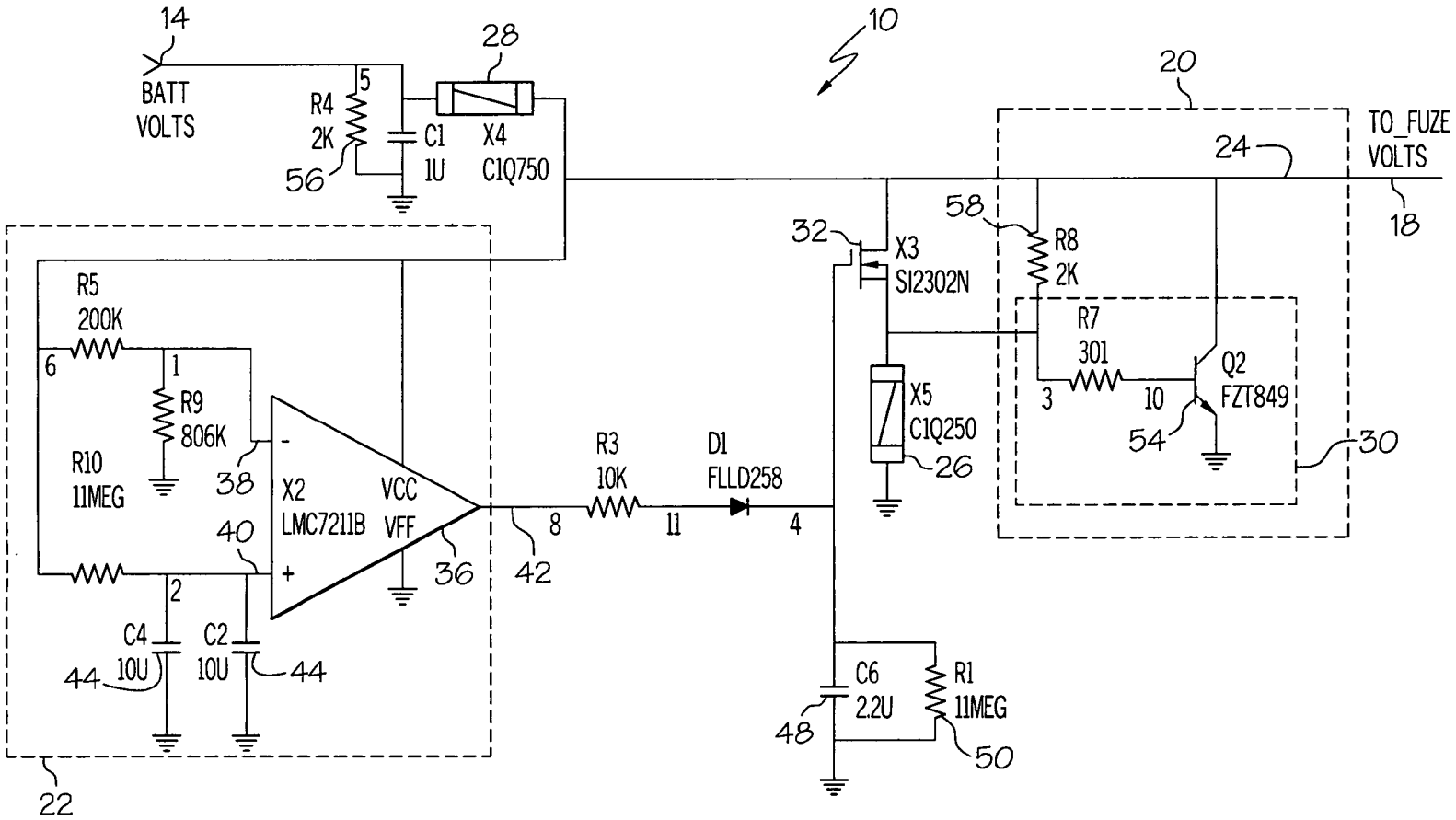
FIG. 1 is an electrical schematic diagram of an embodiment of the inventive Explosive Ordnance Disposal circuit.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

With reference to FIG. 1, an embodiment of the present inventive circuit 10 is depicted in schematic form. This embodiment is particularly useful with fuzes such as the M782 Multi-Option Fuze for Artillery. The components of this specific embodiment have been designed for use with projectile weapons, such as 105 mm and 155 mm howitzer munitions which typically have a 199 second mission time. A person of ordinary skill in the art will recognize that specific tolerances of various components may be adjusted for use in other applications, and that certain illustrated components may be substituted by other components that equivalently produce the desired results.

The detonation of projectile weapons are typically controlled by a fuze which operates in a safe mode until arming, whereinafter detonation may occur. Current artillery fuzes use the detection of two unique environments to activate a reserve battery and then a mechanical safe and arming (S&A) device to move the detonator in-line with the firing circuit after a safe separation distance has been achieved. The arming event is then electronically determined by the operating mode of the fuze. For example, if the fuze is in the TIME mode it will arm after an operator selected time minus 0.5 seconds and then detonate at the selected time. This operation is well known in the art.

The present EOD circuit 10 may be installed in-line with the battery that supplies the entire fuze with power. The EOD circuit 10 is desirably configured to be initiated upon activation of the fuze's reserve battery.

Fuzes such as the M782 typically have an operational voltage range from 5.6 to 12 volts. The EOD circuit 10 of FIG. 1 is designed to operate at a nominal 8 volts, but is capable of proper operation throughout the typical voltage ranges and fluctuations encountered.

The EOD circuit 10 includes a power source input 14, a timer 22, a first trigger 26, a second trigger 28, a no-fire threshold circuit 30 and an output circuit 20 having an output line 24 which may supply voltage to a fuze input power line 18 of a fuze (not shown) such as an M782. Upon activation of the fuze's reserve battery, a full operating voltage is supplied to the power source input 14, and the EOD circuit is initiated. This activates the timer 22, and also provides a full operating voltage to the fuze input power line 18, allowing the projectile to achieve high-order detonation during the mission time.

If the fuze properly detonates within the mission time, the projectile and fuze have accomplished the mission and the EOD circuit is not required. The EOD circuit is destroyed in the high-order detonation. However, if the fuze has failed to detonate after the mission time has lapsed, the EOD circuit works to control the energy provided to the fuze input power line 18 to a level lower than a threshold value required for fuze detonation.

At EOD circuit 10 initiation, operational voltage, such as a nominal 8 volts DC reaches the fuze input power line 18 and the timer 22. The operational voltage does not travel to the first trigger 26 or through the no-fire threshold circuit 30 immediately upon circuit initiation.

The timer 22 comprises Resistance-Capacitance circuitry and an IC comparator 36. In the embodiment of FIG. 1, the comparator 36 is a Tiny CMOS Comparator with Rail-to-Rail Input model LMC7211B from National Semiconductor Corporation. The comparator 36 has a reference voltage line 38, an input signal line 40 and the timer output 42. When the timer is initiated, operational voltage is supplied to the reference voltage line 38, but voltage on the input signal line 40 remains low due to a drain by timer capacitors 44. As the timer capacitors 44 charge, voltage on the input signal line 40 increases. When the voltage on the input signal line 40 becomes equal to or exceeds the voltage of the reference voltage line 38, the comparator 36 provides an output voltage to the timer output 42.

The amount of time passage that occurs between initiation of the EOD circuit 10 and when voltage is provided to the timer output 42 is desirably slightly longer than the mission time of the explosive. For a typical 155 mm howitzer artillery shell, the mission time is set at 199 seconds. Therefore, the capacitors 44 of the RC circuit illustrated in the timer 22 of FIG. 1 will reach a voltage equal to the voltage on the reference voltage line 38 approximately 200 seconds after EOD circuit initiation. For applications where lesser or greater time spans are desired, the capacitor and/or resistor values within the timer 22 may be adjusted accordingly.

Current from the timer output 42 allows filter capacitor 48 to charge. As the filter capacitor 48 charges, the voltage level rises and, after reaching a threshold value, forward biases the gate of a field effect transistor 32. In the embodiment of FIG. 1, the field effect transistor 32 is a MOSFET model SI2302N manufactured by Siliconix Corporation, having a gate-threshold voltage in the range of 0.65 to 1.2 volts. When the field effect transistor 32 turns on, operational voltage from the power source input 14 reaches and initiates the first trigger 26.

When the first trigger 26 is initiated, the no-fire threshold circuit 30 becomes activated. In the embodiment of FIG. 1, the first trigger 26 is desirably a fast acting low current fuse connected to ground. As depicted, the first trigger 26 is a Very Fast-Acting Chip Fuse model C1Q250 from Bel Fuse Corporation, rated at 250 mA. Upon first trigger 26 initiation, meaning in this embodiment that current in excess of 250 mA starts to flow through the first trigger 26 and causes it to blow, current flow is diverted from ground to the base of the transistor 54, which turns on the transistor 54, thereby activating the no-fire threshold circuit 30. Thus, the first trigger 26 acts as a non-volatile memory device permanently activating transistor 54. The first trigger 26 desirably initiates in a very short time period. While the Bel Fuse C1Q250 will open the circuit at a current of 250 mA or more, if the current exceeds 750 mA, which is three times its rating, it will open the circuit within 200 milliseconds.

The no-fire threshold circuit 30 includes a transistor 54 which acts as a switch to connect the fuze input power line 18 to ground. When the first trigger 26 is initiated, power is routed to the base of the transistor 54. In the embodiment of FIG. 1, the transistor 54 is desirably a high current NPN transistor, such as a model FZT849 from Zetex Semiconductors. When power is supplied to the base of the transistor 54, the fuze input power line 18 becomes connected to ground through the transistor 54, thereby initiating the second trigger 28 and lowering the energy available to the fuze input power line 18 to a level below a threshold energy level required by the fuze for detonation.

Due to the capacitance of the fuze firing capacitor circuitry and the EOD circuit 10 as depicted in FIG. 1, the voltage provided to the fuze input power line 18 must be less than 1.02 volts in order to have the total energy available to the fuze input power line 18 be less than the government specified no-fire threshold energy required for an M782 fuze to detonate. The 1.02 volt level is determined from the specified no-fire energy threshold using the well known formula $\frac{1}{2} CV^2$ and the specific firing capacitor value of the fuze. With the specified voltage of 1.02 and a capacitance of 47 microfarads, the energy threshold is 24.45 microjoules for the circuit of FIG. 1.

The second trigger 28 is desirably a second fast acting low current fuse. As depicted in FIG. 1, the second trigger 28 is a Very Fast-Acting Chip Fuse model C1Q750 from Bel Fuse Corporation. The second trigger 28 has a higher initiation current requirement than that of the first trigger 26, 750 mA with the C1Q750 fuse used in the circuit of FIG. 1. This insures that the first trigger 26 will always initiate first and activate transistor 54. Typically, when the fuze input power line 18 is grounded through the transistor 54, the second trigger 28 will initiate, thereby opening the circuit and isolating the fuze and its EOD circuit 10 from the power source.

The second trigger 28 must allow appropriate current flow to the circuit for operation of the fuze circuit and its EOD circuit comprised of the timer 22, field effect transistor 32, first trigger 26 and no-fire threshold circuit 30, but should also be capable of isolating the power source when it is required to lower the fuze input power line 18 below the no-fire threshold voltage. The fuze operating current can be over 300 mA in some operating modes.

On occasion, batteries used as a power source for fuze circuits lose voltage over the mission time. In the EOD circuit of FIG. 1, the second trigger 28 will initiate (meaning that the fuse 28 will blow, isolating the fuze circuit from the power source input 14) if the power source is still providing operational voltage when the no-fire threshold circuit 30 is activated. However, if the power source is operating at a voltage level lower than required for second trigger 28 initiation, the second trigger 28 will not initiate. In such a case of lowered input voltage, the grounding of the fuze input power line 18 through the transistor 54 serves to lower the fuze input power line 18 energy below the no-fire threshold (i.e. voltage at the fuze input power line 18 below 1.02 v). Specifically, in the embodiment of FIG. 1, the Zetex Semiconductors model FZT849 transistor has a collector to emitter voltage of 0.1 and will therefore lower the fuze input power line 18 voltage accordingly.

Thus, the second trigger 28 should be designed to allow adequate current flow to the fuze and its EOD circuit 10 during the mission time, and also to trigger isolation of the power source after activation of the no-fire threshold circuit 30 if it is required to lower the energy available to the fuze input power line 18 to a level below the no-fire threshold.

Circuit 10 also includes a first bleed resistor 56 arranged from the power source input 14 to ground, and a second bleed resistor 58 arranged across the field effect transistor 32. In the embodiment depicted in FIG. 1, both the first bleed resistor 56 and the second bleed resistor 58 are 2K ohm resistors. A leakage resistor 50, desirably an 11 megaohm resistor, is used to prevent charge build-up on the filter capacitor 48 which could prematurely activate the no-fire threshold circuit 30.

Figure 2:
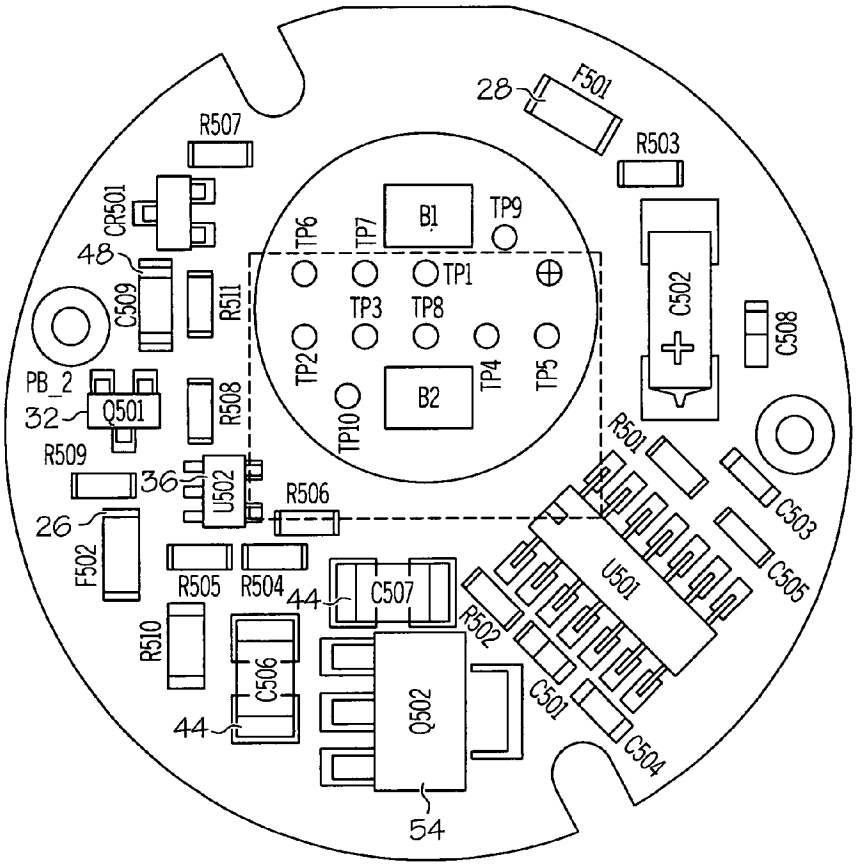
FIG. 2 is a view of an embodiment of the inventive Explosive Ordnance Disposal circuit on a printed wire board.

FIG. 2 depicts the embodiment of FIG. 1 of the EOD circuit 10 on a printed wire board.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An apparatus for interrupting power supplied to a detonation device, the apparatus comprising:

a power line that provides power to said apparatus and to said detonation device, the power line comprising a power line fuse;

a timer;

a no-fire threshold circuit;

an electronic switch comprising a terminal connected to said no-fire threshold circuit; and an activation fuse connected to said terminal;

wherein a predetermined time period after voltage is supplied to said power line, said timer closes said electronic switch and causes said activation fuse to blow, and wherein after said activation fuse blows, said no-fire threshold circuit is activated to reduce the voltage of said power line to a level below a predetermined threshold required for said detonation device to fire.

2. The apparatus of claim 1, wherein activation of said no-fire threshold circuit blows said power line fuse.

3. The apparatus of claim 2, wherein said power line comprises a power source side and a detonation device output side, and when said power line fuse blows, said power source side is isolated from said detonation device output side.

4. The apparatus of claim 1, wherein said power line fuse has a higher current rating than said activation fuse.

5. The apparatus of claim 4, wherein when said activation fuse blows, said no-fire threshold circuit is permanently activated.

6. The apparatus of claim 1, wherein when said no-fire threshold circuit is activated said power line is shorted to ground.

7. An explosive ordnance disposal circuit (EOD) comprising:

a power line that provides voltage to the EOD circuit and to a detonation device;

a timing circuit which is automatically activated when voltage is supplied to the power line;

a trigger element which is triggered by the timing circuit after a predetermined time, and and a power line voltage control circuit connected to the trigger element, which is constructed and arranged to short said power line to ground upon triggering of the trigger element.

8. The circuit of claim 7 further comprising a power source supplying a voltage in the range of 5.6 to 12 volts.

9. An explosive ordnance disposal circuit (EOD) comprising:

a power line that provides voltage to the EOD circuit and to a fuze;

a timing circuit which is activated when voltage is supplied to the power line;

a trigger element which is triggered by the timing circuit after a predetermined time; and and a power line voltage control circuit connected to the trigger element, which is constructed and arranged to reduce voltage of the power line below a predetermined no-fire threshold voltage value upon triggering of the trigger element;

wherein the timer circuit is comprised of a comparator having a reference voltage line and an input voltage line, the input voltage line being connected to a capacitor element which begins to charge upon activation of the timing circuit, the predetermined time to trigger being the time sufficient to charge the capacitor element to equalize the voltage on both the reference voltage line and the input voltage line, thereby providing the comparator with a comparator output voltage connected to the power line voltage control circuit.

10. The circuit of claim 9 wherein the power line voltage control circuit includes an FET transistor connected to a FET activation capacitor which is charged by the comparator after the predetermined time has elapsed, the FET transistor being turned on when the FET activation capacitor has charged sufficiently to exceed the gate threshold voltage of the FET transistor.

11. The circuit of claim 10 wherein the trigger element is a first fuse which blows when the FET transistor turns on and the current flowing through the first fuse exceeds a first predetermined current threshold, the first fuse blowing activating the power line voltage control circuit to reduce voltage of the power line below the predetermined no-fire threshold voltage value.

12. The circuit of claim 11 wherein the power line voltage control circuit includes a transistor connecting the power line to ground, the transistor being turned on when the first fuse blows.

13. The circuit of claim 12 wherein the power line is also connected to a second fuse, the second fuse blowing when the current flowing through the second fuse exceeds a second predetermined current threshold, thereby isolating the fuze from a power source.

14. A method for disposing of ordnance which fails to detonate within a predetermined mission time comprising:

providing an explosive ordnance disposal circuit (EOD) comprising a power line having a fuse, a timing circuit, a trigger element and a no-fire circuit, the power line providing voltage to a detonation device;

starting the timing circuit upon provision of voltage to the power line;

triggering the trigger element after the timing circuit has operated for the predetermined mission time;

wherein the no-fire circuit shorts the power line to ground and blows said fuse upon triggering of the trigger element.

15. An explosive ordnance disposal circuit used in conjunction with an electronic fuze comprising:

a timer;

a first fuse;

a no-fire circuit; and a power line having a second fuse;

wherein a predetermined time period after said power line is supplied with voltage, said timer causes said first fuse to be blown; and wherein when said first fuse is blown, said no-fire circuit grounds the power line.

16. The explosive ordnance disposal circuit of claim 15, wherein the no-fire circuit shorts the power line to ground and blows the second fuse.

17. An explosive ordnance disposal circuit used in conjunction with a fuze comprising:

a timer;

a trigger; and an output line providing an output voltage;

wherein upon activation of a reserve battery of said fuze, said timer being automatically supplied with voltage; wherein a predetermined time period after said timer is supplied with voltage, said timer outputs a voltage which causes said trigger to be initiated; and wherein when said trigger is initiated, the output voltage is controlled to a level lower than a predetermined threshold required for detonation of said fuze.

18. An explosive ordnance disposal circuit used in conjunction with an electronic fuze comprising:

a timer;

a power line comprising a first portion and a second portion, the first portion connected to a power supply, the second portion providing an output voltage to said electronic fuze; and a fuse positioned in-line between the first portion and the second portion of the power line;

wherein a predetermined time period after said timer is automatically supplied with voltage, said timer outputs a voltage which causes said second portion of the power line to be shorted to ground, thereby blowing said fuse.

19. An explosive ordnance disposal circuit used in conjunction with a fuze comprising:

a timer;

a trigger that can be activated only once; and a power line providing voltage automatically to said timer and providing an output voltage to said fuze;

wherein a predetermined time period after said power line is supplied with voltage, said timer outputs a voltage which causes said trigger to be activated; wherein when said trigger is activated, the output voltage is controlled to a level lower than a predetermined threshold required for detonation of said fuze.

* * * * *